US005107530A

United States Patent [19]

Allison

[11] Patent Number: 5,107,530

[45] Date of Patent: Apr. 21, 1992

[54] X-RAY DIFFRACTOMETER WITH SHUTTER CONTROL

[75] Inventor: Gerald L. Allison, Corvallis, Oreg.

[73] Assignee: The State of Oregon Acting by and Through the Oregon State Board of Higher Education on Behalf of Oregon State University, Eugene, Oreg.

[21] Appl. No.: 712,144

[22] Filed: Jun. 6, 1991

[51] Int. Cl.[5] ..... G21K 1/04

[52] U.S. Cl. ..... 378/160; 378/151; 250/233

[58] Field of Search ..... 378/160, 161, 114, 117, 378/151, 73, 71, 70, 64; 250/233

[56] References Cited

U.S. PATENT DOCUMENTS 4,195,229 3/1980 Suzuki ..... 378/160

4,962,517 10/1990 Koga ..... 378/160

*Primary Examiner*—Janice A. Howell

*Assistant Examiner*—Don Wong

*Attorney, Agent, or Firm*—Klarquist, Sparkman, Campbell, Leigh & Whinston

[57] ABSTRACT

A reliable shutter position indicator for an x-ray diffractometer utilizes an optical shutter position sensor for detecting the position of a shutter of the x-ray diffractometer. In one embodiment, a pair of optical isolators are utilized with an arm coupled to the shutter shifting to a position to interrupt a light beam of the optical isolators when the shutter is in either the open or closed position. The controller of the x-ray diffractometer then compares the detected shutter position with the expected shutter position to determine whether a shutter error is present.

7 Claims, 2 Drawing Sheets

X-RAY DIFFRACTOMETER WITH SHUTTER CONTROL

The present invention relates to the control of the shutter of an x-ray diffractometer and more specifically relates to an x-ray diffractometer with a non-magnetic shutter position sensor and indicator.

BACKGROUND OF THE INVENTION

X-ray diffractometers are known in the art and are used for applications such as directing an x-ray beam toward a crystal to obtain reflection angles of the beam from the crystal for use in studying the crystal. The analysis of a crystal using an x-ray diffractometer can require a significant amount of time with eight hours to three days not being unusual. During the period of experimentation with a crystal, the shutter of the x-ray diffractometer may be opened and closed 10,000 to 15,000times in a 24-hour period.

In a conventional x-ray diffractometer, such as a Model No. AFC6, RU200B Series x-ray diffractometer from Rigaku Corporation of Japan, the shutter comprises a rotary controlled shutter element which is rotated between a first closed position and a second open position. When the shutter is open, a path is provided between a radiation source and a target, such as a crystal. In this apparatus, a solenoid is rotated to rotate a shaft which in turn rotate the shutter. A bar magnet is supported on the shaft and is shifted as the shaft rotates between a first position, corresponding to the closed position of the shutter, and a second position, corresponding to the open position of the shutter. As the shaft rotates between the respective first and second positions, reed switches at these positions are activated to provide a shutter position indicating signal.

In operation, a computer controller of the Rigaku device causes the solenoid to shift the shutter to a desired position, such as to the second or open position. The computer then receives a position indicating signal from one of the reed switches and compares this signal with the expected position corresponding to the position to which the shutter has been operated by the solenoid in response to the controller. If the expected position does not correspond to the detected position determined from the signals from the reed switches, a shutter error position signal is generated. In the case of a shutter error, the solenoid is operated to close the shutter and the system shuts down.

Because of the large number of shutter operations normally required during the analysis of a crystal or during other uses of the x-ray diffractometer, the reed switches tend to wear, with frequent component replacement being required. Also, proper alignment of the replacement reed switches is difficult to attain. Furthermore, as the parts deteriorate through use, false shutter position indicating signals are generated and result in the erroneous shutdown of the equipment. This results in a substantial loss of many hours of experimentation time, particularly when x-ray diffractometers are set up for the automatic running of an experiment overnight or on a weekend with a researcher returning and learning that the experiment has stopped midstream. In addition, sometimes valuable sample crystals are lost due to the instability of these crystals and the fact that these crystals lack the stability simply to restart an experiment which has erroneously been terminated.

The inventor has found that the Rigaku system as described above frequently provided false shutter position errors, with errors occurring at least once every three or four days over many periods of operation of the x-ray diffractometer.

This problem with accurately controlling and detecting the presence of a shutter under the adverse operating conditions required by an x-ray diffractometer have been present for a number of years. That is, since the Rigaku x-ray diffractometer mentioned above was introduced, the inventor understands that this problem of generating false shutter position signals has plagued users of this device without being solved. The assignee of the present invention first obtained this model of Rigaku x-ray diffractometer in November of 1987.

Therefore, a need exists for an improved shutter control mechanism for an x-ray diffractometer designed to overcome these and other problems of the prior art.

SUMMARY OF THE INVENTION

An x-ray diffractometer directs an x-ray beam toward a target through a shutter. The x-ray diffractometer has a controller for causing the shifting of the shutter between a first closed position, in which the passage of the x-ray beam through the shutter is blocked, and a second open position, in which the passage of the x-ray beam through the shutter is not blocked by the shutter. The controller has an input for receiving a shutter position indicating signal. The controller compares the shutter position corresponding to the shutter position indicating signal with the expected shutter position corresponding to the shutter position to which shutting of the shutter has been caused by the controller. The shutter is caused to be shifted to a closed position in the event the shutter position corresponding to the shutter position indicating signal does not also correspond to or match the expected shutter position.

In accordance with the invention, an optical shutter position sensor or detector is mounted to a support in proximity to the shutter for sensing the position of the shutter and for producing the shutter position indicating signal. Such a shutter position sensor is a non-mechanical sensor in that it does not rely upon a mechanical switch, that is one in which mechanical components included in an electrical circuit path move to mechanically open and close the circuit utilized in sensing the shutter position. This type of shutter position sensor electronically produces the shutter position indicating signal which corresponds to the position of the shutter.

Although various optical detectors or sensors may be used, including the reflecting optical beam type sensor, a preferred form of the sensor is an interrupting optical beam type sensors. In this specific form of the invention, a mechanism is provided for interrupting a first optical beam when the shutter is in the first closed position and for interrupting a second optical beam when the shutter is in the second open position. The position indicating signal corresponds to the optical beam which is interrupted and thereby indicates the position of the shutter. This mechanism may comprise first and second optical beam breaking elements coupled to the shutter for respectively interrupting the first and second optical beams depending upon the shutter position. Alternatively, the mechanism may comprise a single element, such as an arm mounted to or otherwise coupled to the shutter and movable with the shutter between first and second positions to interrupt the respective first and second optical beams as the shutter is shifted between the first closed position and second open position. This arm may be L-shaped with a flag portion which is disposed between a transmitter and receiver of an optical detector to break a beam being transmitted between the receiver and detector to thereby indicate the shutter position. More specifically, the first and second optical detectors may comprise respective optical isolators each having an optical beam source and an optical beam receiver.

The shutter may be of any convenient form and may comprise a rotary shutter operated in response to control signals from a conventional controller. These control signals may be delivered to a rotary solenoid for shifting the shutter between the first closed position and the second open position.

It is accordingly one object of the present invention to provide an x-ray diffractometer with an improved controller and more specifically with an improved shutter position indicating mechanism.

Another object of the present invention is to provide an x-ray diffractometer which is capable of operating for substantial periods of time without falsely indicating the shutter position, which can cause the termination of an experiment and significant lost time.

Still another object of the present invention is to provide an x-ray diffractometer shutter position sensor which is extremely durable.

These and other objects, features and advantages of the present invention will become apparent with reference to the following description and drawings.

DETAILED DESCRIPTION OF A PREFERRED EMBODIMENT

Figure 1:
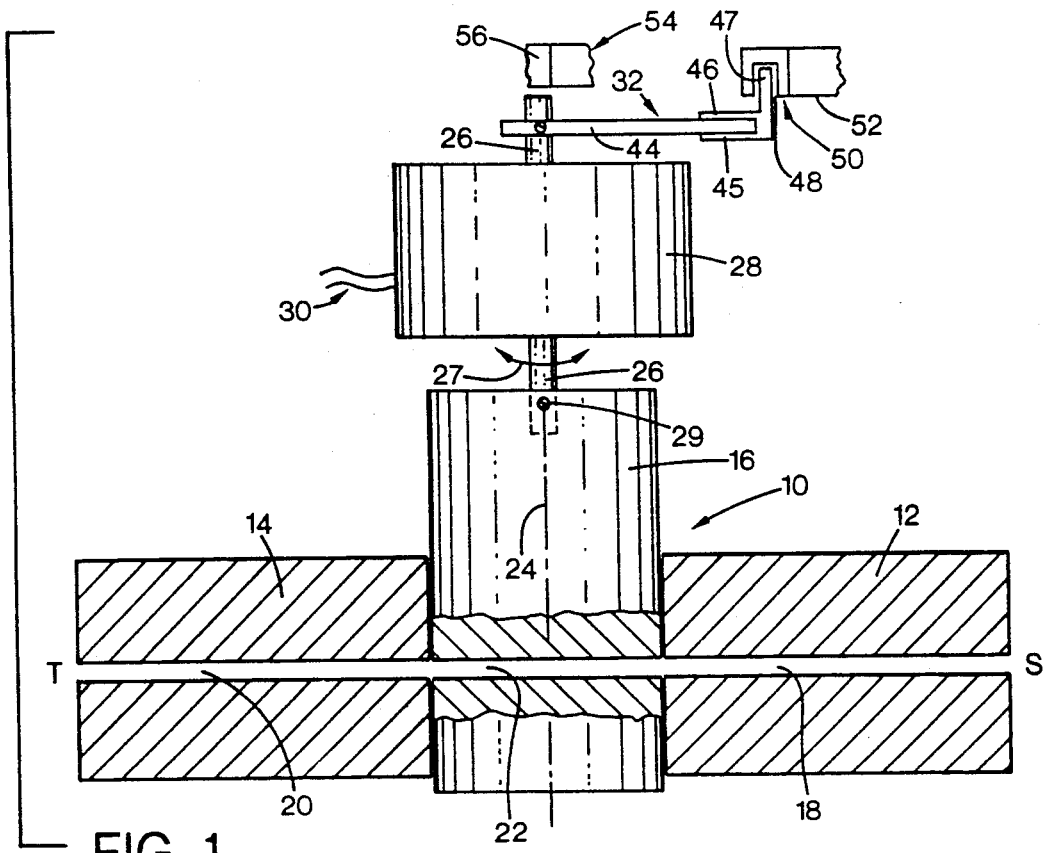
FIG. 1 is a schematic illustration, partially in section, of a shutter mechanism for an x-ray diffractometer.
Figure 2:
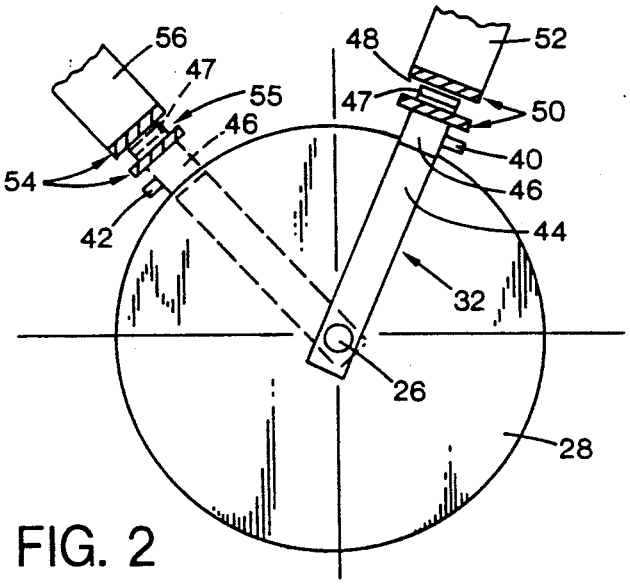
FIG. 2 is a top plan view of the shutter portion of the apparatus of FIG. 1.
Figure 3:
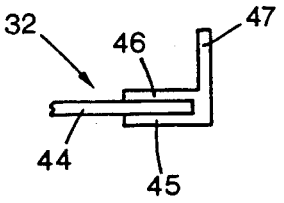
FIG. 3 is an isometric view of a portion of one form of an optical beam interrupting arm utilized in the embodiment of FIG. 2.

With reference to FIGS. 1-3, a shutter assembly 10 for an x-ray diffractometer is shown with first and second fixed shutter elements 12 and 14 and a movable shutter 16 positioned therebetween. Each of the elements 12, 14 has a respective elongated aperture or passageway 18, 20 extending along the longitudinal axis of the associated shutter element. The aperture 18 is aligned with the aperture 20. The movable shutter 16 also includes an aperture 22, which is aligned with the apertures 18 and 20 when the shutter 16 is in an open position. As shown in FIG. 1, when the shutter is open, an x-ray beam from a source S may pass through the apertures 18, 22 and 20 to a target T, such as a crystal having a structure which is being analyzed using the x-ray diffractometer.

When the shutter 16 is shifted to a closed position, the aperture 22 no longer is in alignment with the apertures 18 and 20, thereby blocking the x-ray beam path through the shutter assembly 10. Typically the shutter elements 12, 14 and 16 are of lead or other x-ray impermeable material and are supported within a housing of the x-ray diffractometer, the housing not being shown in FIG. 1.

Although a sliding or otherwise movable shutter 16 may be used, the illustrated shutter 16 comprises a rotary shutter which is mounted to the housing (not shown) for rotation about an axis 24 which is generally orthogonal to the aperture or passage 22. More specifically, the shutter 16 may comprise a right cylindrical shutter with the axis 24 corresponding to the longitudinal axis of the shutter and the passageway 22 extending in a transverse direction through the shutter. The shutter 16 of this illustrated assembly is coupled to a drive shaft 26, as by a set screw 29, to a rotary solenoid 28. In response to control signals on lines 30 from a conventional controller of the x-ray diffractometer, the solenoid 28, or other drive mechanism, rotates and more specifically pivots or reciprocates the shaft in directions indicated by arrow 27 about the axis 24. As the shaft 26 is shifted, the shutter 16 is also shifted in response to signals from the controller, between a closed position and an open position. Again, when the shutter is in the open position, the apertures or passages 18, 22 and 20 are in alignment to permit the passage of an x-ray beam from the source S to the target T.

A shaft position indicator, such as the projecting arm assembly 32, is mounted to the shaft 26 for pivoting movement with the rotation of the shaft. As the shutter 16 is shifted between respective closed and open positions, the arm assembly 32 is similarly moved between a first position, corresponding to the closed position of the shutter, and a second position, corresponding to the open position of the shutter as shown in FIG. 1.

With specific reference to FIGS. 1, 2 and 3, when the shutter 16 is in the open position, an arm 44 of the assembly 32 is in the position shown in solid lines in FIG. 2 and against a stop 40. Conversely, when the shutter 16 is shifted to a closed position, the arm 44 is moved against a stop 42 as shown in dashed lines in FIG. 2. The respective stops 40 and 42 are mounted to the frame or housing (not shown) of the x-ray diffractometer.

As shown in FIGS. 1 and 3, the illustrated arm assembly 32 includes the elongated arm 44 and a flag portion 47 extending orthogonally upwardly from the arm. The flag may be formed as part of an end cap. That is, the flag may be connected to a pair of spaced apart legs 45, 46 which project from the flag 47 and form a socket therebetween for receiving the distal end of the arm 44 to in effect cap the end of the arm 44. Upon shifting the arm 44 to the open position shown in FIGS. 1 and 2, the flag 47 is inserted into a gap 48 of an optical isolator 50. When in this gap, the flag 47 interrupts an optical beam being transmitted between an optical beam source and an optical beam receiver of the optical isolator 50. As explained below in connection with FIG. 4, the interruption of the optical beam by the arm assembly 32 causes the generation of a position indicating signal indicating the position of the arm and thereby the corresponding position of the shutter in the open position. The optical isolator 50 is shown mounted to a support 52 connected to the framework of the diffractometer.

Upon shifting the shutter 16 to a closed position, the flag 47 enters a gap 55 of an optical isolator 54. The optical isolator 54 also has an optical beam source and optical beam receiver which is interrupted when the flag 47 is positioned in this gap. When the beam is interrupted, the position indicating circuit of FIG. 4, as explained below, generates a position indicating signal which indicates the positioning of the arm and shutter in the closed position. The optical isolator 54 may also be mounted to a support 56 connected to the framework of the x-ray diffractometer. Both of the optical isolators 50, 54 are typically mounted to a circuit board (not shown) which are supported in a position for the optical isolators to receive the flag 47 as the shutter 16 is caused to shift between the respective open and closed positions.

Figure 4:
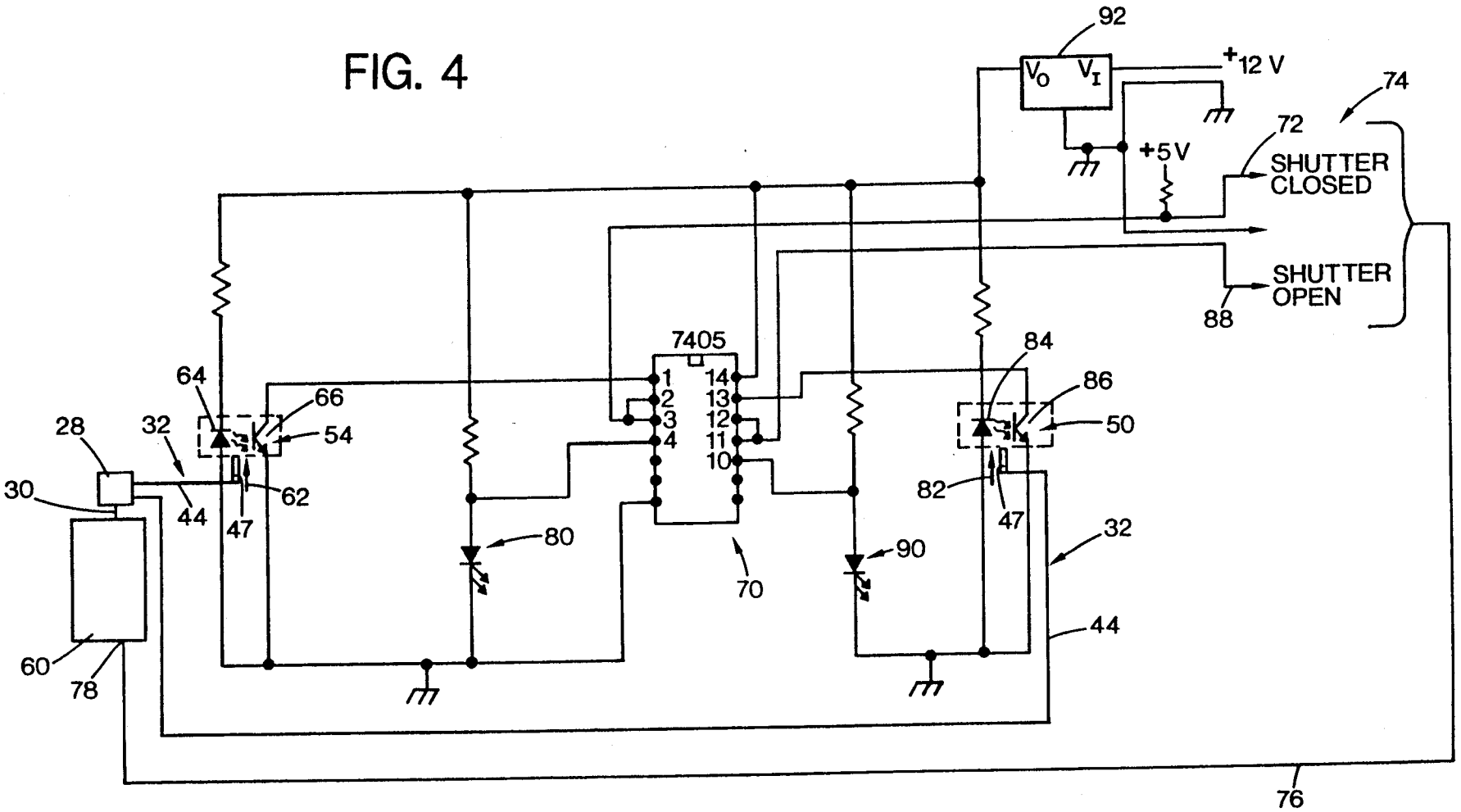
FIG. 4 is an electrical schematic diagram of an x-ray diffractometer with a shutter position detecting circuit in accordance with an embodiment of the present invention.

With reference to FIG. 4, a conventional controller 60 for an x-ray diffractometer, such as for the Rigaku Model AFC6, RU200B series x-ray diffractometer is shown. In a conventional manner, assume the controller 60 generates a control signal on line 30 to cause the solenoid 28 to rotate the shaft 26 and shutter 16 (FIG. 1) to a closed position. In this case, the arm 44, and more specifically the flag 47, is inserted as indicated by arrow 62 into the gap of the optical isolator 54. When placed in this position, the light beam or source from a light emitting diode 64 of the optical isolator 54 no longer impinges upon the base of the transistor 66. The base of the transistor 66 is an optical beam receiver of this optical isolator. As a result, the transistor 66 ceases to conduct. Consequently, the voltage of the collector of transistor 66 raises to a logic 1 level (e.g. five volts) and is applied to pin 1 of a switch 70. Switch 70 in this illustrated embodiment comprises a Texas Instruments TTL open collector switch 7405. When the input at pin 1 of switch 70 goes to a logic 1, the output at pin 3 of this switch goes to a logic 0 and appears as a logic 0 at line 72 of an interface 74 which is coupled by a line 76 to a shutter position signal input 78 of the controller 60. Simultaneously, the output at pin 4 of the switch 70 rises to a logic 1 value. This causes a light emitting diode 80 to conduct to thereby provide a visual indication to an operator of the machine at a remote location that the arm 32, and thus the shutter 16 (FIG. 1) has shifted to its closed position.

Conversely, assume controller 60 causes the solenoid 28 to operate to shift the arm 32 to the open shutter position. In this case, the flag 47 is shifted as indicated by arrow 82 into the gap of the optical isolator 50. In this case, the optical beam or light from a light emitting diode 84 of the optical isolator no longer reaches the base of a transistor 86. Under these conditions, transistor 86 ceases to conduct, and its collector rises to a logic 1 level. Also, the level at pin 13 of switch 70 to which the collector of the transistor 86 is coupled rises to a logic 1. Under these circumstances, the output at pin 11 drops to a logic 0 level and appears at this level at the output 88 of the interface 74. This position indicating signal, corresponding to the shutter being in the open position, is coupled by way of lines 76 to the input 78 of the controller. The signals on lines 72 and 88 are typically delivered to separate inputs of the controller for use by the controller in monitoring the sensed position of the shutter and comparing this sensed position with the expected position based on the control signals transmitted by the controller to the solenoid 28.

It should also be noted that when the shutter is in the open shutter position, that is when flag 46 is positioned in the gap of optical isolator 50, the output at pin 10 of switch 70 goes to a logic 1 level. As a result, a light emitting diode 90 conducts and emits light to provide a visual indicator to an operator at a remote location that the shutter is now in an open shutter position. The diodes 80 and 90 may be of a different color to aid an operator in distinguishing whether the shutter is detected in the open or closed position.

The circuit shown in FIG. 4 also includes a voltage regulator 92 for providing a 5 volt regulated output voltage ($V_0$) in response to a 12 volt input voltage ($V_I$), the 12 volt input voltage being available from the above-described Rigaku x-ray diffractometer. In addition, the resistors shown in FIG. 4, although they may be varied, are typically each at one kilohm.

Based on the control signals sent by the controller 60 to the solenoid 28, an expected shutter position is known by the controller. That is, if the signals to the solenoid 28 are such that the shutter 16 (FIG. 1) should be shifted to the open position, the expected shutter position is the open position. Conversely, if the signals from the controller 60 to the solenoid 28 are those which would shift the solenoid and shutter to the closed position, the expected shutter position would be the closed position. The controller 60 compares the shutter position indicated by the signal on line 76 with the expected shutter position. If the expected and sensed or detected shutter positions do not correspond, that is they do not match, a shutter error is indicated. In this case, the shutter is caused to shift to a closed position by the controller and the operation of the x-ray diffractometer is ended until a user of the device resets the device.

As mentioned in the background of the invention portion of the Application, a conventional shutter control system utilized in this type of x-ray diffractometer produced frequent false shutter error signals (wherein the detected shutter position was incorrect and caused the system to falsely indicate a shutter error and shut down). For example, it was not unusual to have at least one shutter error signal being generated every three or four days during many periods of operation of such an x-ray diffractometer. In contrast, the shutter control system of the present invention, when tested over the past nine months, did not produce a single false shutter error signal. That is, no shutter error signals have occurred when the expected shutter position did not match the detected or sensed shutter position.

Having illustrated and described the principles of my invention with reference to a preferred embodiment, it should be apparent to those of ordinary skill in the art that this invention may be modified in arrangement and detail without departing from such principles. For example, the interrupting type optical isolators described in connection with the preferred embodiment may be replaced by reflecting type optical detectors. I claim as my invention all such variations which fall within the scope of the following claims.

I claim:

1. In an x-ray diffractometer apparatus in which an x-ray beam is directed toward a target through a shutter, the x-ray apparatus having a controller for causing the shifting of the shutter between a first closed position in which the passage of the x-ray beam through the shutter is blocked by the shutter and a second open position in which the passage of the x-ray beam through the shutter is not blocked by the shutter, the controller having an input for receiving a shutter position indicating signal, the controller comparing the shutter position corresponding to the shutter position indicating signal with an expected shutter position caused by the controller, the controller being operable to shift the shutter to a closed position in the event the shutter position which corresponds to the position indicating signal does not also correspond to the expected shutter position, comprising:

a support;

an optical shutter position sensor mounted to the support in proximity to the shutter for sensing the position of the shutter and for producing the shutter position indicating signal; and the controller input being coupled to the shutter position sensor for receiving the shutter position indicating signal, whereby the controller compares the sensed shutter position corresponding to the shutter position indicating signal with the expected shutter position and causes the shutter to shift to the first closed position in the event the sensed and expected shutter positions do not correspond.

2. An apparatus according to claim 1 in which the optical sensor includes first and second optical beams, the optical sensor interrupting the first optical beam when the shutter is in the first position and interrupting the second optical beam when the shutter is in the second position, the position indicating signal indicating the optical beam which is interrupted and thereby indicates the position of the shutter.

3. An apparatus according to claim 2 in which the optical sensor includes an arm mounted to the shutter and movable with the shutter between first and second positions as the shutter is shifted between the first closed position and the second open position, the arm interrupting one of the first and second optical beams when the arm is in the first position and interrupting the other of the first and second optical beams when the arm is in the second position.

4. An apparatus according to claim 3 in which the arm has a flag portion disposed in position to interrupt the respective one of the first and second optical beams when the arm is either in the first position or in the second position.

5. An apparatus according to claim 4 in which the arm is L-shaped.

6. In an x-ray diffractometer apparatus in which an x-ray beam is directed toward a target through a rotary shutter, the x-ray apparatus having a controller for causing the rotation of the shutter between a first closed position in which the passage of the x-ray beam through the shutter is blocked by the shutter and a second open position in which the passage of the x-ray beam is not blocked by the shutter, the controller having an input for receiving a shutter position indicating signal, the controller comparing the shutter position corresponding to the shutter position indicating signal with an expected shutter position caused by the controller, the controller being operable to rotate the shutter to a closed position in the event the shutter position corresponding to the position indicating signal does not correspond to the expected shutter position, comprising:

an arm mounted to the shutter and rotatable with the rotation of the shutter to a first position when the shutter is in the first closed position and to a second position when the shutter is rotated to the second open position;

a support;

a first optical detector mounted to the support and positioned to detect the presence of the arm in the first position, the optical detector producing a first position indicating signal upon detection of the arm in the first position;

a second optical detector mounted to the support and positioned to detect the presence of the arm in the second position, the optical detector producing a second position indicating signal upon detection of the arm in the second position;

the first and second position indicating signals being coupled to the input to the controller, whereby the controller compares the sensed shutter position corresponding to the received first and second position indicating signals with the expected shutter position and causes the shutter to shift to the first closed position in the event the sensed shutter position and expected shutter position do not correspond.

7. An apparatus according to claim 6 in which the first and second optical detectors each comprise an optical isolator having an optical beam source and optical beam receiver, an optical beam being transmitted between the optical beam source and optical beam receiver, the first optical detector producing the first position indicating signal upon the interruption of its optical beam, the second optical detector producing the second position indicating signal upon the interruption of its optical beam, the arm comprising means for interrupting the first optical beam when the arm is in the first position and for interrupting the second optical beam when the arm is in the second position.

* * * * *

UNITED STATES PATENT AND TRADEMARK OFFICE

CERTIFICATE OF CORRECTION

PATENT NO. : 5,107,530

DATED : April 21, 1992

INVENTOR(S) : Gerald L. Allison

It is certified that error appears in the above-identified patent and that said Letters Patent is hereby corrected as shown below:

Column 1, line 20 (specification page 1, lines 15 and 16), "15,000times" should be --15,000 times--;

Column 1, line 29 (specification page 1, line 24), "which" should be --to--;

Column 2, line 53 (specification page 4, line 2), "sensors" should be --sensor--;

Signed and Sealed this

Ninth Day of November, 1993

*Attest:*

Bruce Lehman

BRUCE LEHMAN

*Attesting Officer*

*Commissioner of Patents and Trademarks*